US009330579B2

(12) United States Patent
Weinstein

(10) Patent No.: US 9,330,579 B2
(45) Date of Patent: May 3, 2016

(54) PATIENT WRISTBAND

(71) Applicant: Medirex Systems Inc., Toronto (CA)

(72) Inventor: Barry B. Weinstein, Toranto (CA)

(73) Assignee: Medirex Systems Inc., Ontario (CA)

( * ) Notice: Subject to any disclaimer, the term of this patent is extended or adjusted under 35 U.S.C. 154(b) by 0 days.

(21) Appl. No.: 14/396,661

(22) PCT Filed: Apr. 23, 2013

(86) PCT No.: PCT/CA2013/000374
§ 371 (c)(1),
(2) Date: Oct. 23, 2014

(87) PCT Pub. No.: WO2013/159186
PCT Pub. Date: Oct. 31, 2013

(65) Prior Publication Data

US 2015/0096211 A1 Apr. 9, 2015

(30) Foreign Application Priority Data

Apr. 23, 2012 (CA) ..... 2775274

(51) Int. Cl.

| | |
|---|---|
| ***G09F 3/00*** | (2006.01) |
| ***B42D 15/00*** | (2006.01) |
| ***G09F 3/10*** | (2006.01) |
| *G09F 3/02* | (2006.01) |

(52) U.S. Cl.
CPC ..... *G09F 3/005* (2013.01); *B42D 15/00* (2013.01); *G09F 3/0288* (2013.01); *G09F 3/10* (2013.01); *G09F 2003/0202* (2013.01); *G09F 2003/0241* (2013.01)

(58) Field of Classification Search
CPC ..... G09F 3/005; G09F 3/0292; A61B 19/44
USPC ..... 40/630, 633
See application file for complete search history.

(56) References Cited

U.S. PATENT DOCUMENTS

| | | | | | |
|---|---|---|---|---|---|
| 2,988,457 | A | * | 6/1961 | Gatcomb | 442/67 |
| 3,848,112 | A | | 11/1974 | Weichselbaum et al. | |
| 4,122,947 | A | | 10/1978 | Falla | |
| 4,302,496 | A | * | 11/1981 | Donovan | 428/196 |
| 4,429,015 | A | * | 1/1984 | Sheptak | 428/201 |
| 4,584,238 | A | * | 4/1986 | Gen et al. | 428/349 |
| 4,925,906 | A | * | 5/1990 | Green et al. | 526/245 |
| 5,481,758 | A | * | 1/1996 | Gabler | 2/115 |
| 5,653,472 | A | | 8/1997 | Huddleston et al. | |
| 5,867,197 | A | * | 2/1999 | Aoki | 347/106 |

(Continued)

OTHER PUBLICATIONS

Patent Cooperation Treaty, "International Search Report" Canadian Searching Authority, Examiner Maxime Bazinet, document of 2 pages, dated Aug. 6, 2013.

*Primary Examiner* — Shin Kim
(74) *Attorney, Agent, or Firm* — Akerman LLP; Ryan L. Harding

(57) ABSTRACT

A form having a printable nylon taffeta face ply and a liner ply where the face ply is die cut to form one or more blank detachable wristbands having first and second ends. The face ply is adhered to the liner ply by a pressure sensitive adhesive included on at least a portion of its bottom surface and the pressure sensitive adhesive is included on the face ply around the periphery of the one or more wristbands and on a bottom surface of the first and second ends of each of the wristbands. Each of the first and second ends of the wristbands is provided with tamper evident indicia.

16 Claims, 12 Drawing Sheets

(56) References Cited

U.S. PATENT DOCUMENTS

| | | | | |
|---|---|---|---|---|
| 6,058,636 | A * | 5/2000 | Colkmire | 40/630 |
| 6,067,739 | A | 5/2000 | Riley | |
| 6,413,605 | B1 * | 7/2002 | Hoffer | 428/40.1 |
| 6,438,881 | B1 | 8/2002 | Riley | |
| 6,510,634 | B1 | 1/2003 | Riley | |
| 6,641,048 | B1 * | 11/2003 | Schintz et al. | 235/487 |
| 6,960,369 | B2 * | 11/2005 | Pagilagan | 427/288 |
| 7,322,613 | B2 | 1/2008 | Penuela et al. | |
| 7,581,504 | B1 * | 9/2009 | Tsui et al. | 112/475.08 |
| 7,765,728 | B1 * | 8/2010 | Waggoner | 40/633 |
| 7,810,267 | B2 * | 10/2010 | Saint et al. | 40/633 |
| 7,946,065 | B2 * | 5/2011 | Ali et al. | 40/633 |
| 8,066,306 | B1 * | 11/2011 | Valenti et al. | 283/75 |
| 8,181,994 | B1 * | 5/2012 | Valenti et al. | 283/108 |
| 2011/0041370 | A1 | 2/2011 | Saint et al. | |
| 2011/0139834 | A1 * | 6/2011 | Joostberns | A47G 25/90 223/111 |

* cited by examiner

PATIENT WRISTBAND

CROSS REFERENCE TO RELATED APPLICATIONS

This application is a §371 National Phase of PCT/CA2013/000374, filed Apr. 23, 2013, which claims priority to Canadian Patent Application No. 2,775,274, filed Apr. 23, 2012, the entireties of which are incorporated by reference herein.

TECHNICAL FIELD

The present invention relates to a printable form, and more particularly, to a form having one or more wristbands that may be accompanied by a plurality of detachable labels which may be printed with information in a single pass through a printer.

BACKGROUND

It is a common practice in patient care facilities to identify patients with a bracelet or band containing the patient's name or other identification information. The band is generally secured around the wrist of a patient so that patient care facilities personnel can properly identify the patient during his stay. However, while this has been an effective method of identifying patients, many patient care facilities have had problems correlating patient information on specimens, drug prescriptions, physician s orders, etc. Clerical errors in the handling of such routine matters can result in the dispensing of the wrong medicine or treatment to a patient.

Several attempts have been made to improve the correlation of patient information to various patient care facilities forms. For example, Falla, U.S. Pat. No. 4,122,947 teach a prepackaged patient identification kit which includes a wristband, a specimen container and a label for attachment to a patient's record, all of which have been provided with identical patient information. Weichselbaum et el, U.S. Pat. No. 3,848,112, teach a patient identification system in which an identification bracelet secured to a patient is used to dispense a series of tags which are magnetically coded with patient information. However, this method requires the use of a tag reader as well as circuitry which is capable of decoding the information on the tag. Accordingly, while such methods may provide an effective means of identifying a patient for various purposes, such methods are complex and difficult to implement.

U.S. Pat. No. 5,653,472 provides a form having detachable labels and a wristband comprising a printable face ply having first and second major surfaces and having a pressure sensitive adhesive on at least a portion of one surface thereof. The face ply includes first and second adjacent portions, where the first portion of the face ply is die cut to form a detachable wristband having first and second ends and first and second sides. The second portion of the face ply is die cut to form a series of detachable labels. The first ply may comprise a polymer such as polyester and the second portion of the face ply may comprise paper. This form is not soft at hand and can cause chaffing of the skin.

U.S. Pat. No. 6,510,634 provides a multi-layer, multi-web, laser printable, form with an identification band blank that comprises a multi-layered web die cut with a first paper label portion for receiving a printed image and an adhesive backed transparent film layer approximately twice the width of the paper layer so that upon separation from a carrier, the transparent film may be folded over and completely encapsulate the paper layer to moisture proof it and protect it. The transparent film layer includes a pair of adhesive backed tabs at the ends to facilitate its attachment about a patient's wrist or ankle. Multiple wristbands, or identification band blanks, are included on the same sheet to provide a form that is particularly suited for a pediatric admission. In an alternate embodiment, a panel is die cut into the transparent film layer so that upon separation of the wristband from the form, the panel remains adhered and it pulls away to form a window. As the wristband is assembled, the window overlies a portion of the printed surface so that it remains exposed. This form requires training of staff in its application and use, is somewhat time consuming to form and attach to a patient's wrist and is not soft at hand and can cause chaffing of the skin.

U.S. Pat. No. 6,438,881 provides another multi-layer, multi-web, laser printable, page-sized form with an identification band blank. The form comprises a multi-layered web die cut with a first paper label portion for receiving a printed image and an adhesive backed transparent film layer approximately twice the width of the paper layer so that upon separation from a carrier, the transparent film may be folded over and completely encapsulate the paper layer to moisture proof it and protect it. The transparent film layer includes a pair of adhesive backed tabs at the ends to facilitate its attachment about a patient's wrist or ankle. The band blank web is joined to a second multi-layer web with an overlapping glued joint, the second multi-layer web having a plurality of adhesive backed labels die cut into it.

U.S. Pat. No. 6,067,739 also provides a multi-layer, multi-web, laser printable, page-sized form with an identification band blank. The form comprises a multi-layered web die cut with a first paper label portion for receiving a printed image and an adhesive backed transparent film layer approximately twice the width of the paper layer so that upon separation from a carrier, the transparent film may be folded over and completely encapsulate the paper layer to moisture proof it and protect it. The transparent film layer includes a pair of adhesive backed tabs at the ends to facilitate its attachment about a patient's wrist or ankle. The band blank web is joined to a second multi-layer web with an overlapping glued joint, the second multi-layer web having a plurality of adhesive backed labels die cut into it.

Accordingly, there is still a need in the art for an identification system which includes a wristband as well as an accompanying series of labels or tags which can be efficiently provided with correlating identification information, and which can be easily dispensed, may be used for a variety of applications, is easy train staff in its use and application to the wrist, is less time consuming, and which when applied to the patient's wrist is sufficiently waterproof and soft at hand and can remain attached to the patient for several days without losing printed variable patient data, cause chaffing of the skin, or become easily detached during patient's stay in the care facility.

SUMMARY OF THE INVENTION

One embodiment of a form is provided having one or more blank detachable wristbands comprising a printable nylon taffeta face ply and a liner ply where the face ply is die cut to form one or more blank detachable wristbands having first and second ends. The face ply is adhered to the liner ply by a pressure sensitive adhesive included on at least a portion of its bottom surface and the pressure sensitive adhesive is included on the face ply around the periphery of the one or more wristbands and on a bottom surface of the first and second ends of each of the wristbands. Each of said first and second ends of each of the wristbands are provided with tamper evident indicia. The form may be printed in a single pass through a printer which provides unique patient identification information on the wristband. The wristband may be peeled away from the form and attached to a patient's wrist by simply wrapping the wristband around the patient's wrist, folding on of the ends of the wristband back so its bottom surface is adhered to the bottom surface of the wristband wrapped over it. The other end of the wristband is adhered to the top surface of the wristband that it is wrapped over. The form may be printed using a variety of printers including mechanical impact, direct thermal, thermal transfer, ink jet, and laser printers.

In accordance with another embodiment, a form is provided having a series of detachable labels and one or more blank detachable wristbands. The form comprises a printable face ply and a liner ply. The printable face ply has first and second adjacent portions, where the first portion of the face ply is a nylon taffeta material die cut to form one or more blank detachable wristbands having first and second ends. The second portion of the face ply is die cut to form the series of detachable labels. The liner ply has a release coating on at least a portion of a top surface wherein the face ply is adhered to the liner ply by a pressure sensitive adhesive included on at least a portion of its bottom surface and the pressure sensitive adhesive is included on the face ply around the periphery of the one or more wristbands and on the first and second ends of each of the wristbands. Each of the first and second ends of each of the wristbands are provided with tamper evident indicia. The top surface of the face ply permits indicia to be printed thereon in a single pass through printer with both variable and non-variable information.

The first and second portions of the face ply are separated and may comprise different materials. The first portion of the face ply may be comprised of 100% nylon taffeta coated white on two sides to facilitate printing on a printer and the second portion of the face ply may comprise paper.

The form may be produced from a continuous web to facilitate printing and handling by automated equipment. The continuous web of forms is may be defined by lines of weakness and may be folded zig-zag into a stack or cut to various sizes.

In practice, the plies of the form may be assembled and then the face ply is printed in a single pass through a printer with the desired variable and non-variable information. The wristband may then be detached from the form by peeling it from the liner ply and wrapping the band around the wrist of a patient. The wristband is then secured to the patient by means of the pressure sensitive adhesive on the wristband. The labels which remain on the form may be removed as needed and adhered to patient care facility forms, medicine containers, patient specimens, etc.

The features and advantages of the different embodiments of the invention will become apparent from the following detailed description, the accompanying drawings, and the appended claims.

Other embodiments of the invention will be apparent from the description that follows.

BRIEF DESCRIPTION OF THE DRAWINGS

The invention will now be described, by way of example, with reference to the accompanying drawings in which the same parts are designated by the same numerals, and in which.

DESCRIPTION OF THE PREFERRED EMBODIMENTS

Figure 1:
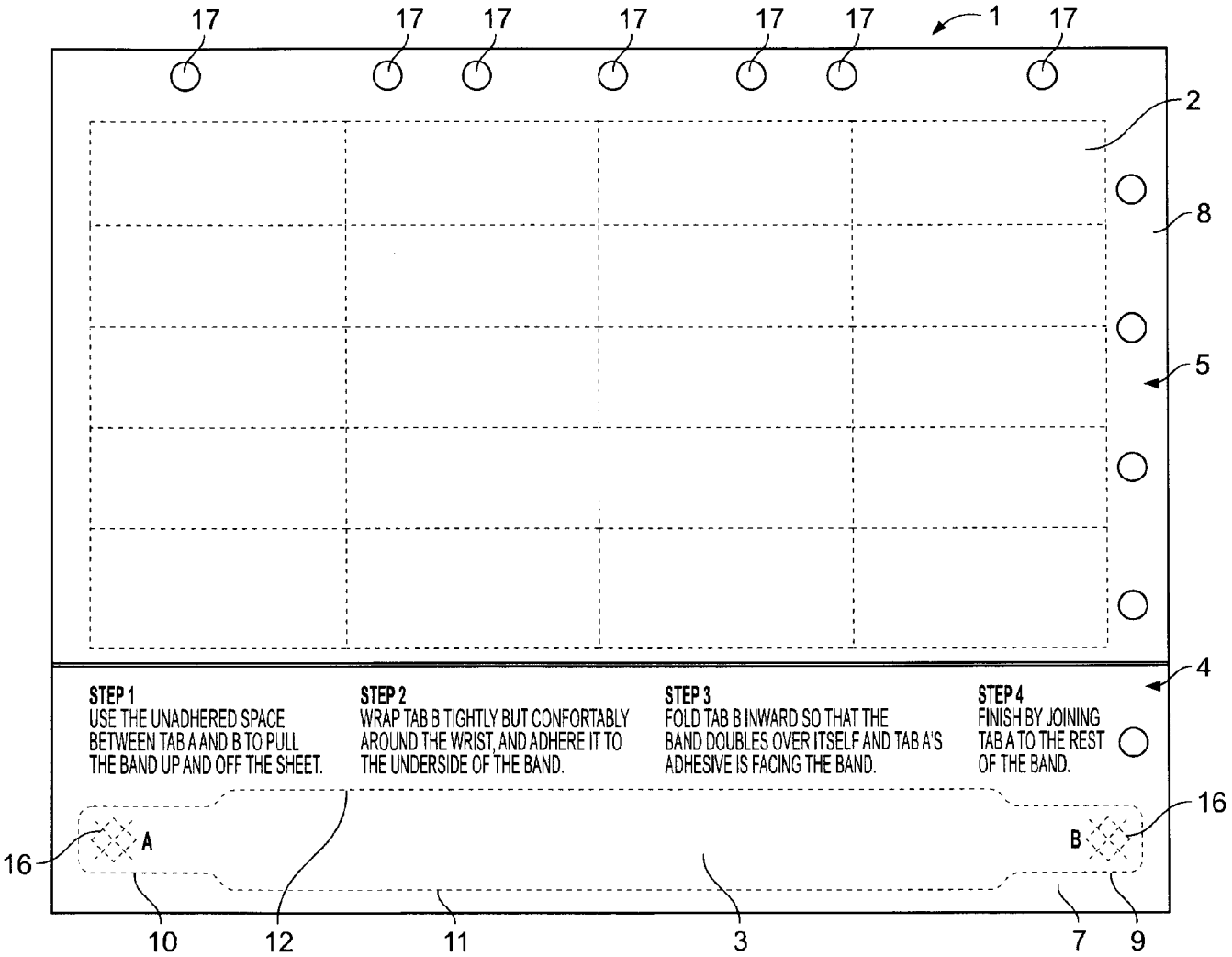
FIG. 1 is a top plan view of one embodiment of a form according to the present invention.
Figure 2:
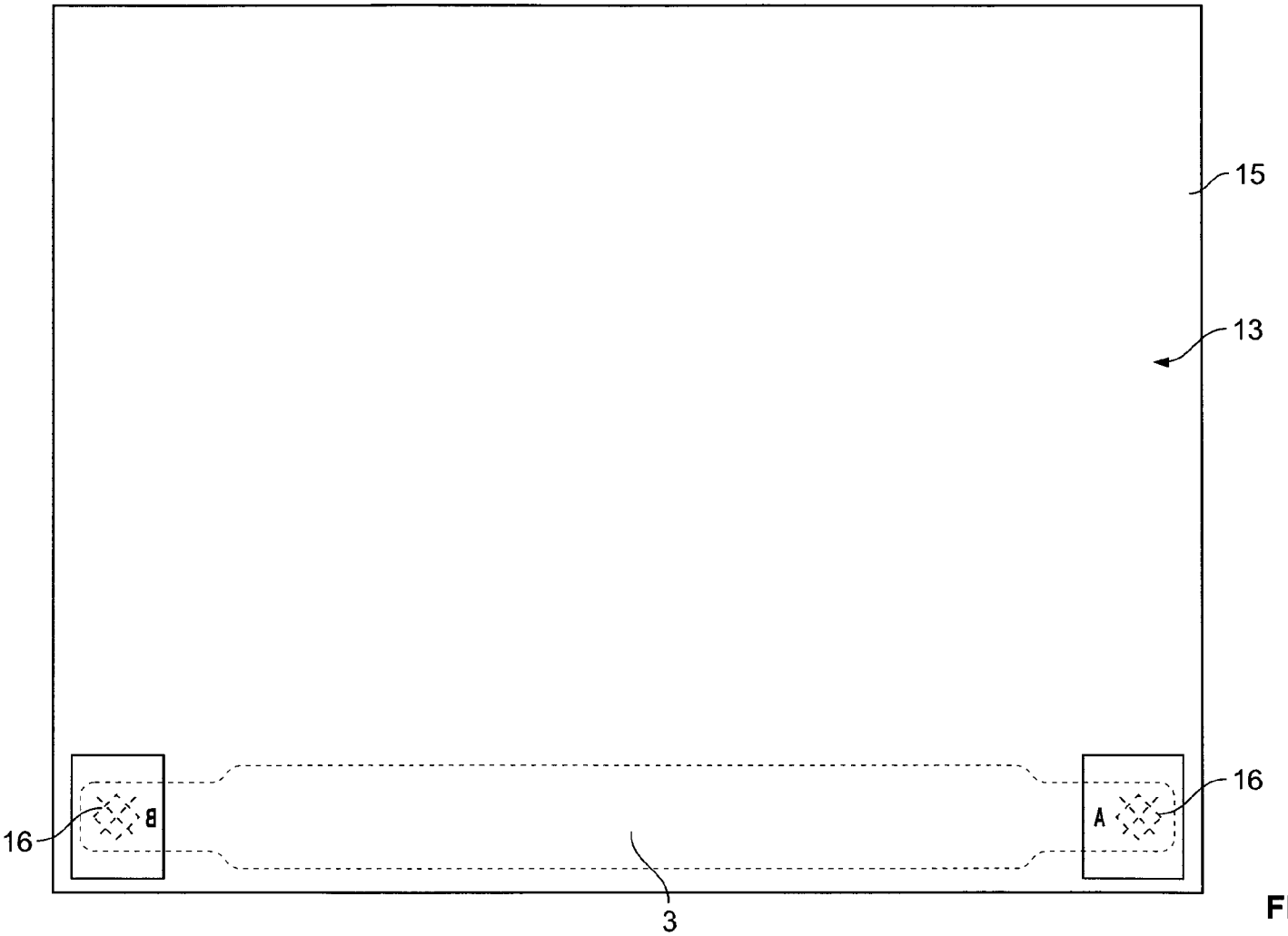
FIG. 2 is a back plan view of the form of FIG. 1.
Figure 3:
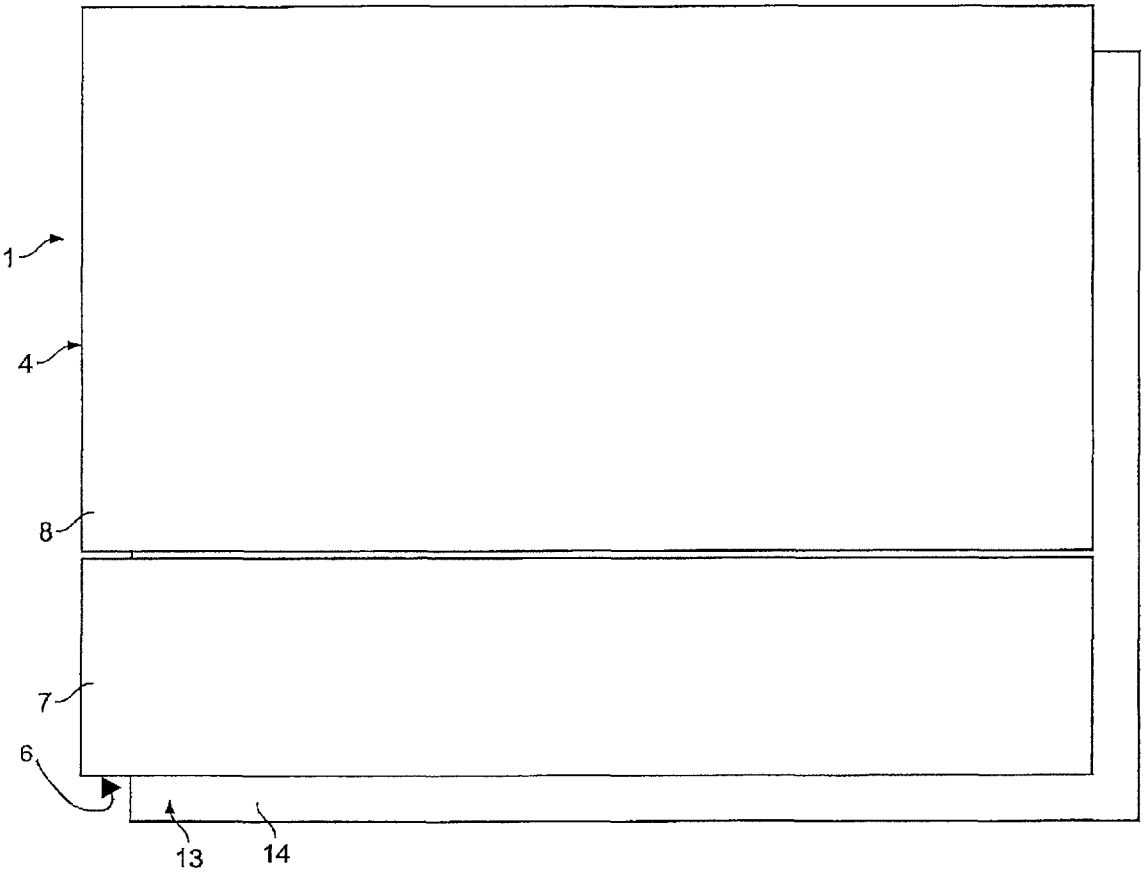
FIG. 3 is a front perspective view of schematic illustration of the form of FIG. 1 showing the different plies forming the form.

FIGS. 1-3 show one embodiment of a form, generally indicated at 1, having detachable labels 2 and a blank detachable wristband 3. Form 1 comprises a printable face ply 4 having top 5 and bottom surfaces and having a pressure sensitive adhesive on at least a portion of the bottom surface 6 thereof. The top surface 5 of the face ply 4 permits indicia to be printed thereon in a single pass through a printer with both variable and non-variable information. In this embodiment the face ply 4 includes first 7 and second 8 adjacent portions, where the first portion 7 of the face ply 4 is die cut to form a detachable wristband 3 having first and second 9, 10 ends and first and second sides 11, 12. The second portion 8 of the face ply 4 is die cut to form a series of detachable labels 2. In other embodiments it is possible to provide only one portion of the face ply die cut to form one or more detachable wristbands if no labels are required. In the embodiment the face ply is between about 2-16 mils thick. The present embodiment uses 4-6 mil ply. When using face ply 8 mil and over it may be required to overcome loss of softness with chemical treatment of the face ply. Chemical softeners for textiles are known.

The form 1 also includes a liner ply 13 having top and bottom surfaces 14, 15. The liner ply 13 includes a release coating on at least a portion of the top surface 14 and is adhered to the pressure sensitive adhesive on the bottom surface 6 of the face ply 4. The liner ply 13 is coextensive with the face ply 4.

The first and second portions 7, 8 of the face ply 4 are separated and may comprise different materials. The first portion 7 of the face ply 4 may be comprised of nylon taffeta coated white on two sides and the second portion 8 of the face ply 4 may comprise paper.

In the embodiment illustrated, the face ply 4 is adhered to the liner ply 13 by a pressure sensitive adhesive included on at least a portion of its bottom surface. In one embodiment, the pressure sensitive adhesive is included on the first portion 7 of the face ply 4 around the periphery of the wristband 3 and on the first and second ends 9, 10 of the wristband 3. The pressure sensitive adhesive is also included on the second portion 8 of the face ply 4 in the area containing the series of labels 2.

In the embodiment illustrated, by making the first portion 7 of the face ply from nylon taffeta, in this case 4-6 mil although other thicknesses between 2-16 mil may be used, the wristband 3 is sufficiently waterproof and soft at hand and can remain attached to a patient for several days without losing printed variable patient data, cause chaffing of the skin, or become easily detached during a patient's stay in the care facility. Further the coating on the nylon taffeta is such that it can now accept and retain the printed indicia.

The plies 4, 13 of the form 1 of the embodiment are assembled and then the face ply 4 is printed in a single pass through a printer with the desired variable and non-variable information. The wristband 3 may then be detached from the form 1 by peeling it from the liner ply 13 and wrapping the wristband 3 around the wrist of a patient. The wristband 3 is then secured to the patient by means of the pressure sensitive adhesive on the ends 9,10 of wristband 3. The labels 2 which remain on the form 1 may be removed as needed and adhered to patient care facility forms, medicine containers, patient specimens, etc.

The wristband 3 is may be provided with tamper evident means 16 to disclose that the wristband 3 has been removed from face ply 4 to prevent mix-up of the wristband 3 printed with one patient's indicia with the labels 2 printed with another patient's indicia or removing the wristband from one patient and applying it to a different patient with different indicia. In the embodiment illustrated in FIG. 1-3, the tamper evident means 16 comprises die cut x's on ends 9,10 of wristband 3 with the bottom surface of each of the ends 9,10 printed a different colour from the rest of the wristband.

To put the wristband 3 illustrated in FIGS. 1-3 on a patient's wrist after printing information on the wristband and any labels, the portion of the wristband 3 between the ends 9,10 is not adhered to the liner ply so may be used to lift the wristband 3 off the liner ply. The end 9 is wrapped tightly but comfortably around the wrist and the bottom surface of end 9 is adhered with pressure sensitive adhesive to the bottom surface of the wristband. The wristband is then wrapped back over itself so that the adhesive on the bottom surface of end 10 is facing the top surface of the band. End 10 is then adhered to the wristband 3. Because the wristband 3 is simply detached from the form 1 then wrapped around a patient's wrist without the need to fold an adhesive backed transparent film layer over and completely encapsulate the printed indicia to moisture proof and protect the wristband as required in a number of the prior art wristbands, it requires less staff training and is easy to apply to the patient and remain well attached to the patient during stay in care facility.

The wristband because it is soft and minimizes chaffing of the skin can be used in a variety of applications—acute care hospitals, long term care facilities, clinics, alternative care facilities, rehab facilities etc. The form may be pre-punched with holes 17 for easy insertion into a chart binder.

Figure 4:
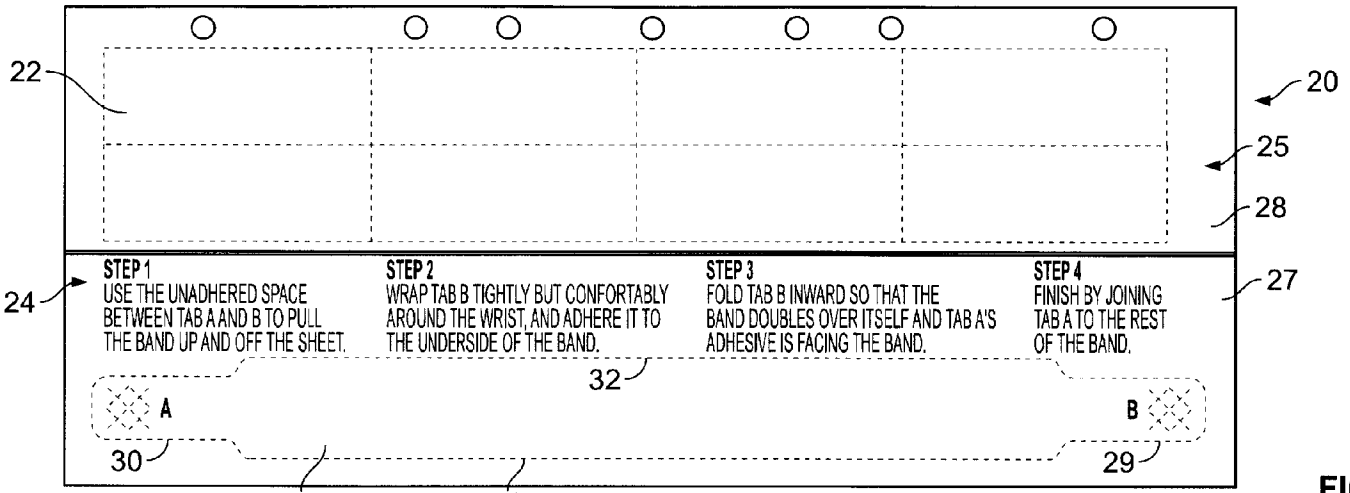
FIG. 4 is a top plan view of another embodiment of a form according to the present invention.
Figure 5:
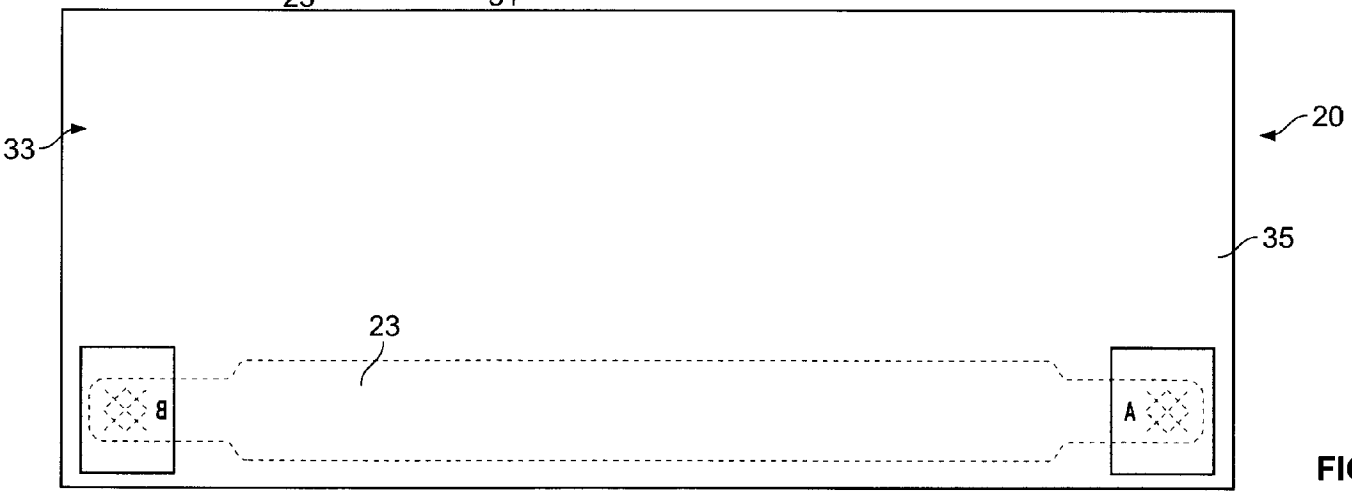
FIG. 5 is a back plan view of the form of FIG. 4.

FIGS. 4-5 show another embodiment of a form, generally indicated at 20, having two rows of detachable labels 22 and a blank wristband 23 for use in registration areas or the like where there is not a need for 18-20 labels for use for example in emergency departments day surgery departments. Form 20 comprises a printable face ply 24 having top 25 and bottom surfaces and having a pressure sensitive adhesive on at least a portion of the bottom surface thereof. The top surface 25 of the face ply 24 permits indicia to be printed thereon in a single pass through printer with both variable and non-variable information. The face ply 24 includes first 27 and second 28 adjacent portions, where the first portion 27 of the face ply 24 is die cut to form a detachable wristband 23 having first and second 29, 30 ends and first and second sides 31, 32. The second portion 28 of the face ply 24 is die cut to form a series of detachable labels 22.

The form 20 also includes a liner ply 33 having top and bottom surfaces 34, 35. The liner ply 33 includes a release coating on at least a portion of the top surface 34 and is adhered to the pressure sensitive adhesive on the bottom surface of the face ply 24. The liner ply 33 is coextensive with the face ply 24.

The first and second portions 27, 28 of the face ply 4 are separated and may comprise different materials. The first portion 27 of the face ply 24 may be comprised of nylon taffeta coated white on two sides and the second portion 28 of the face ply 24 may comprise paper.

In the embodiment illustrated, the face ply 24 is adhered to the liner ply 33 by a pressure sensitive adhesive included on at least a portion of its bottom surface. In one embodiment, the pressure sensitive adhesive is included on the first portion 27 of the face ply 24 around the periphery of the wristband 23 and on the first and second ends 29, 30 of the wristband 23. The pressure sensitive adhesive is also included on the second portion 28 of the face ply 24 in the area containing the series of labels 22. The wristband 23 is attached to a wrist in the same manner as noted above for the embodiment in FIGS. 1-3.

Figure 6:
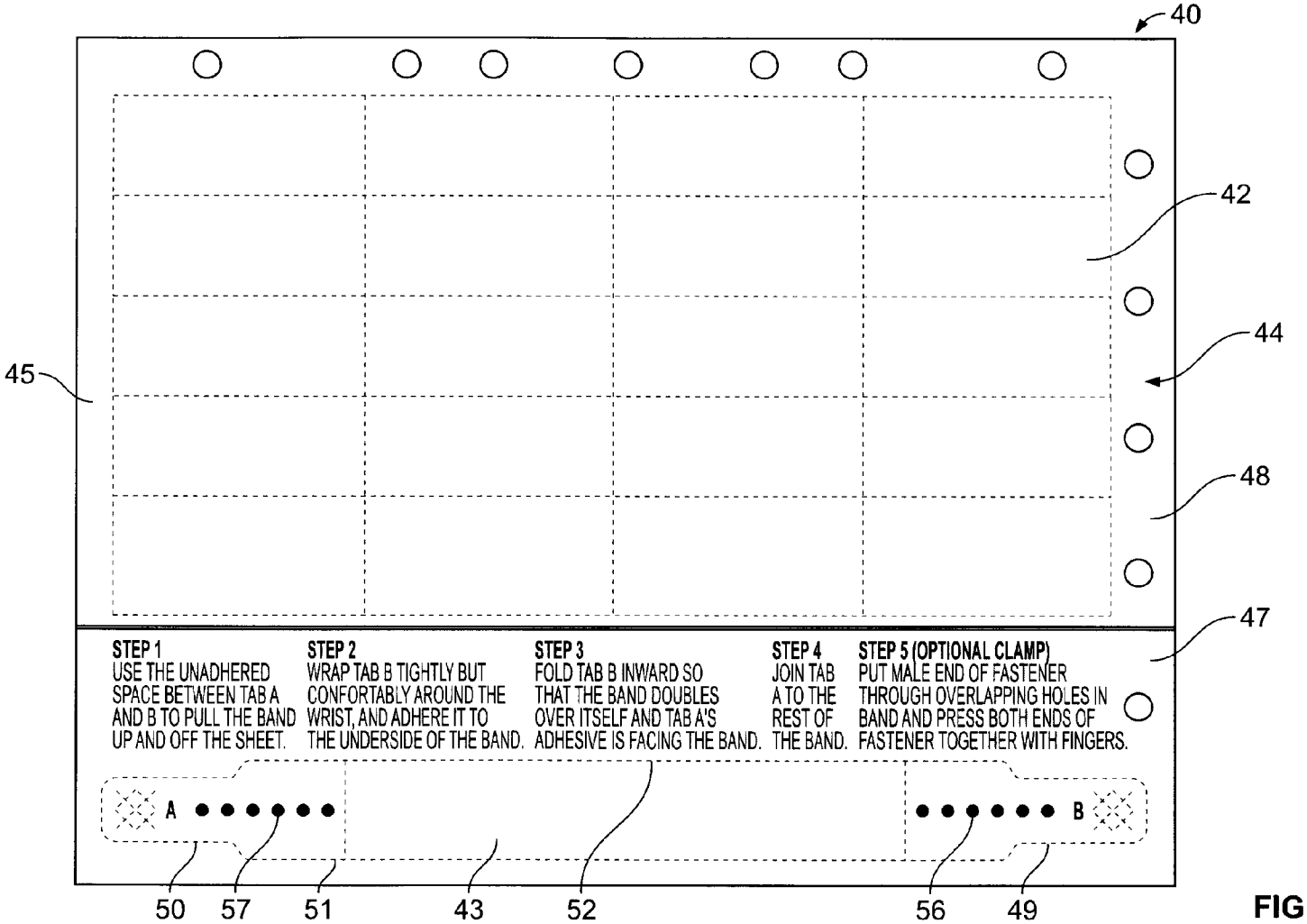
FIG. 6 is a top plan view of another embodiment of a form according to the present invention.
Figure 7:
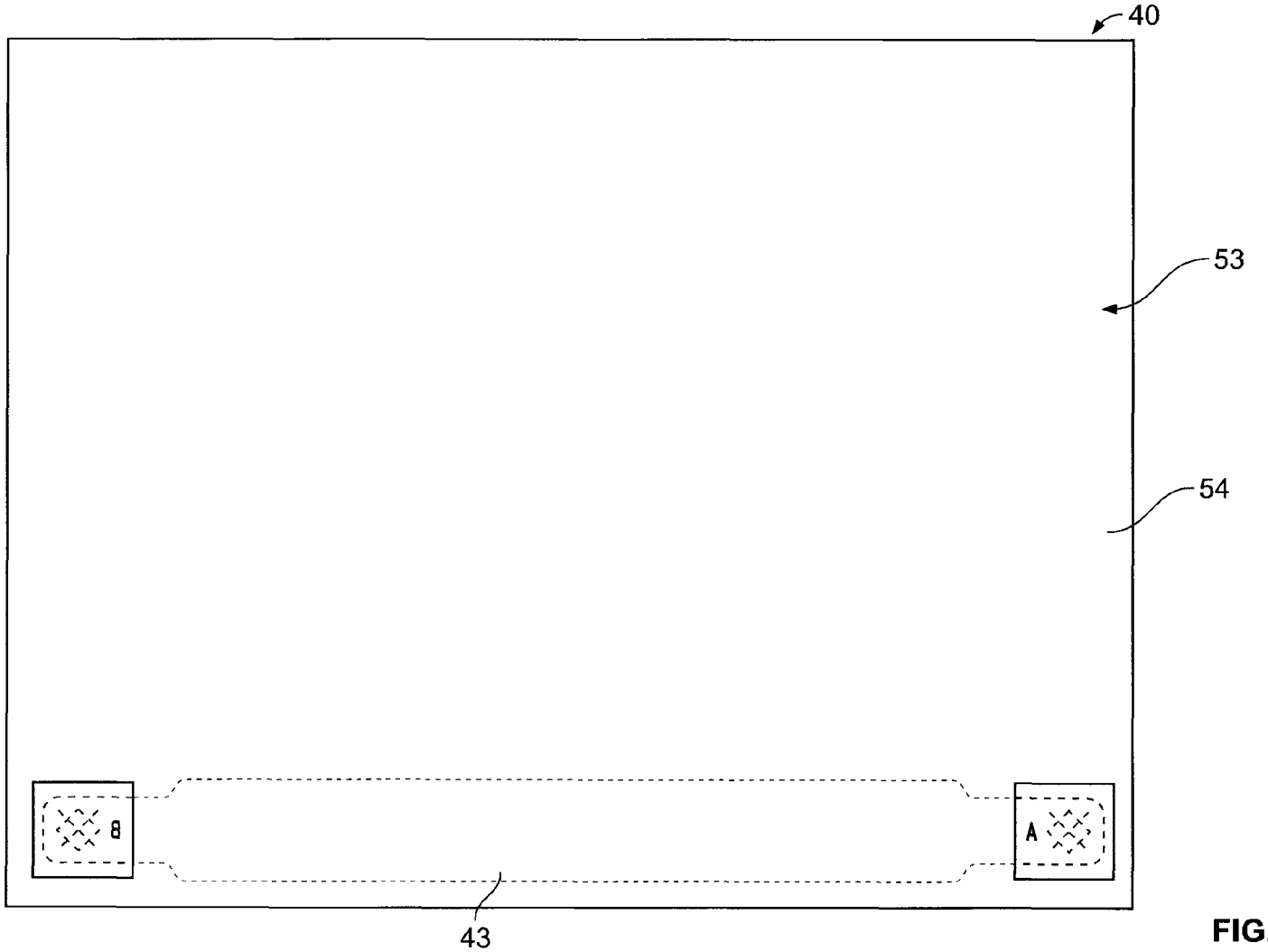
FIG. 7 is a back plan view of the form of FIG. 6.

FIGS. 6-7 show another embodiment of a form, generally indicated at 40, having detachable labels 42 and a blank detachable wristband 43. Form 40 comprises a printable face ply 44 having top 45 and bottom surfaces and having a pressure sensitive adhesive on at least a portion of bottom surface 46 thereof. The top surface 45 of the face ply 44 permits indicia to be printed thereon in a single pass through printer with both variable and non-variable information. The face ply 44 includes first 47 and second 48 adjacent portions, where the first portion 47 of the face ply 44 is die cut to form a detachable wristband 43 having first and second 49, 50 ends and first and second sides 51, 52. The second portion 48 of the face ply 44 is die cut to form a series of detachable labels 42.

The form 40 also includes a liner ply 53 having top and bottom surfaces 54, 55. The liner ply 53 includes a release coating on at least a portion of the top surface 54 and is adhered to the pressure sensitive adhesive on the bottom surface of the face ply 44. The liner ply 53 is coextensive with the face ply 44.

The first and second portions 47, 48 of the face ply 44 are separated and may comprise different materials. The first portion 47 of the face ply 44 will be comprised of nylon taffeta coated white on two sides and the second portion 48 of the face ply 44 may comprise paper.

In the embodiment illustrated, the face ply 44 is adhered to the liner ply 53 by a pressure sensitive adhesive included on at least a portion of its bottom surface. In this embodiment, the pressure sensitive adhesive is included on the first portion 47 of the face ply 44 around the periphery of the wristband 43 but not on the first and second ends 49, 50 of the wristband 43. To secure this wristband 43 to the wrist of a patient a series of holes 56,57 are provided at the ends 49,50 of wristband 43. The holes 56, 57 are adapted to have a plastic snap enclosure inserted through a hole 56 on the first end 49 of wristband 43 and then after the wristband is wrapped around a patient's wrist, through one of the holes 57 on the second end 50 of wristband 43, then closed to lock the wristband on a patient's wrist. This type of attachment provides a greater degree of security to prevent accidental removal of the wristband. The pressure sensitive adhesive is also included on the second portion 48 of the face ply 44 in the area containing the series of labels 42.

Figure 8:
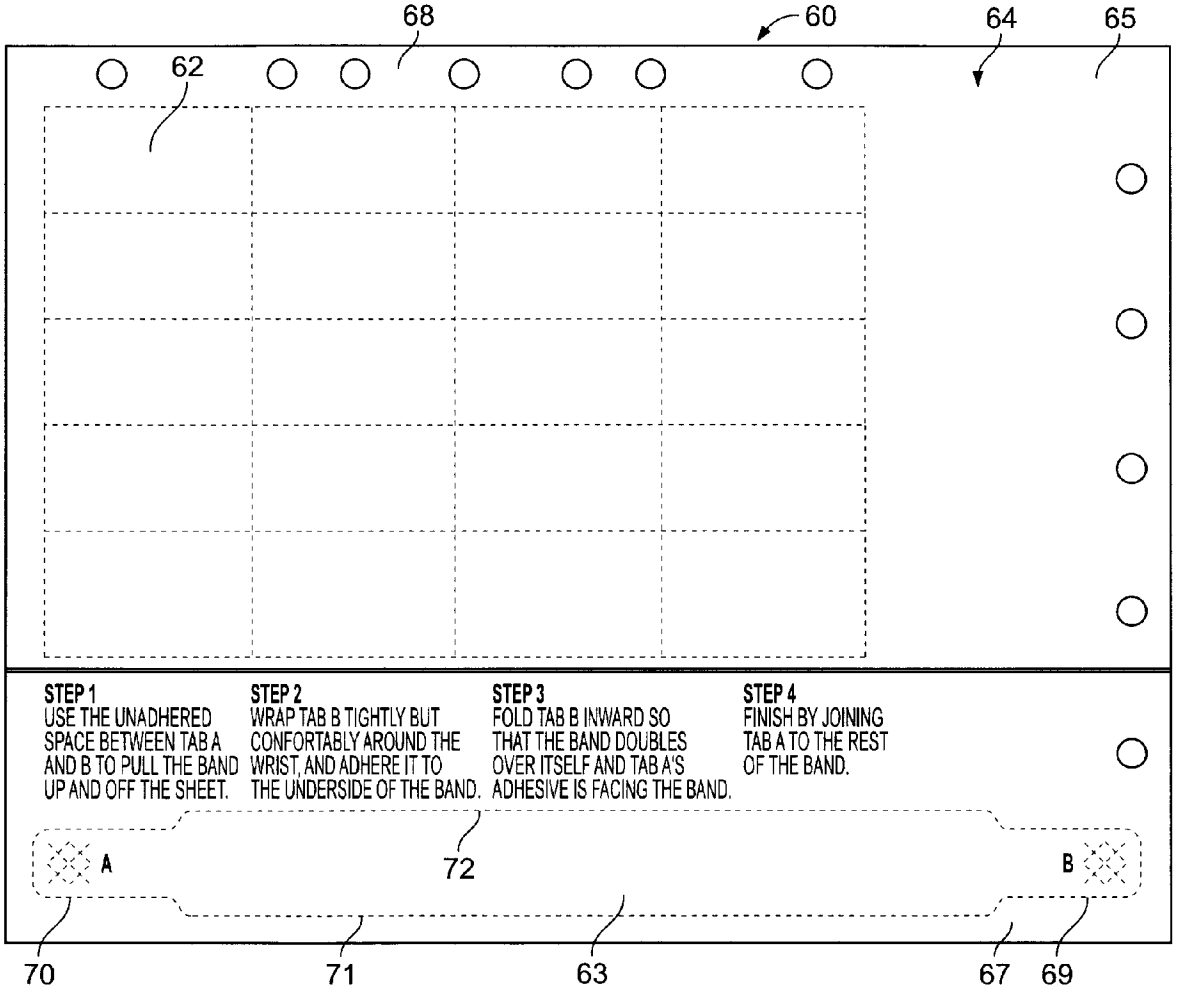
FIG. 8 is a top plan view of another embodiment of a form according to the present invention.
Figure 9:
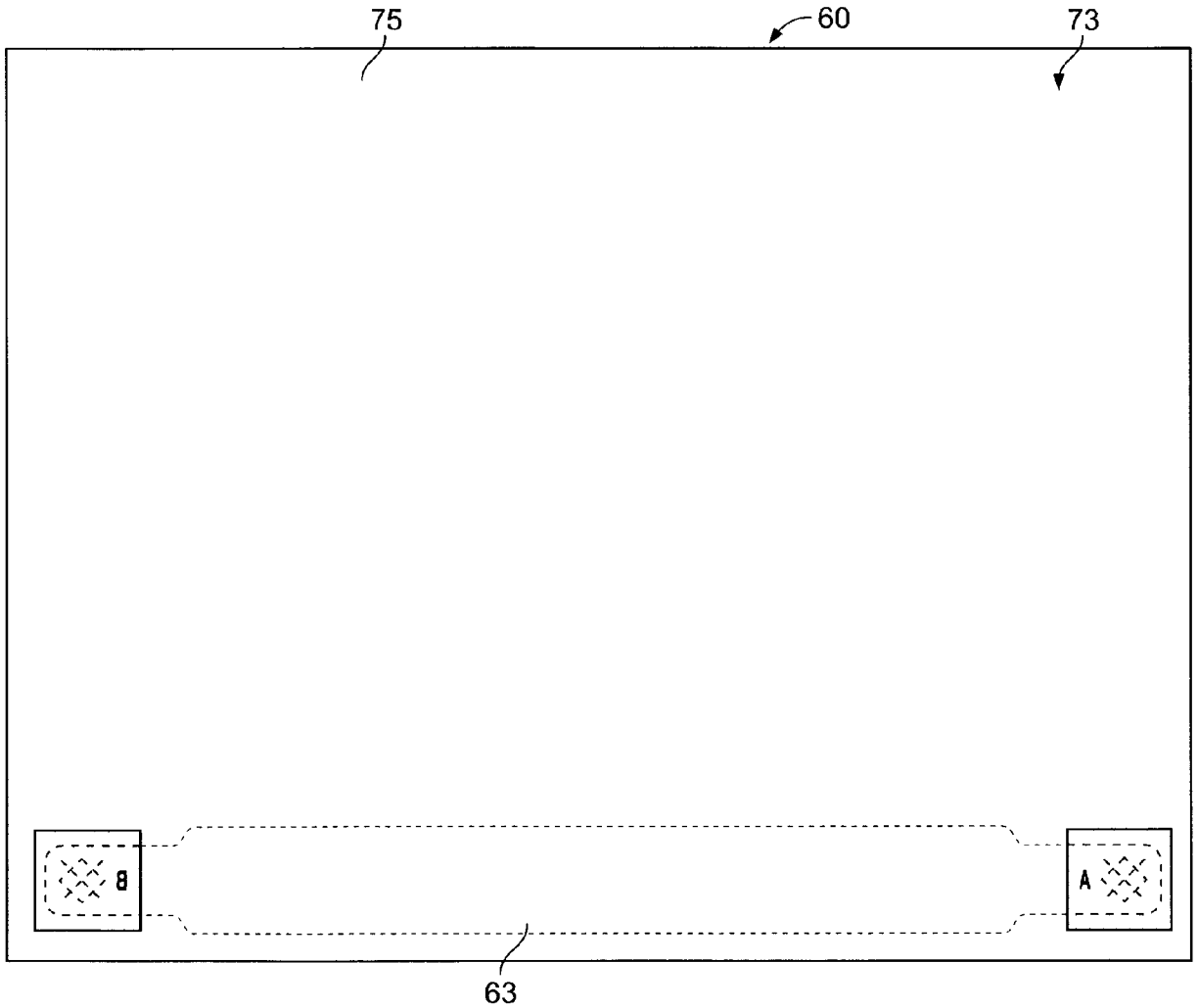
FIG. 9 is a back plan view of the form of FIG. 8.

FIGS. 8-9 show another embodiment of a form, generally indicated at 60, having detachable labels 62 and a large band wristband 63 suitable for use with overweight or very muscular people have wrists that are too large in diameter for the standard length wristband to close around hence large band or longer wristband utilized. Form 60 comprises a printable face ply 64 having top 65 and bottom major surfaces and having a pressure sensitive adhesive on at least a portion of the bottom surface thereof. The top surface 65 of the face ply 64 permits indicia to be printed thereon in a single pass through printer with both variable and non-variable information. The face ply 64 includes first 67 and second 68 adjacent portions, where the first portion 67 of the face ply 64 is die cut to form a detachable wristband 63 having first and second 69, 70 ends and first and second sides 71, 72. The second portion 68 of the face ply 64 is die cut to form a series of detachable labels 62.

The form 60 also includes a liner ply 73 having top and bottom major surfaces 74, 75. The liner ply 73 includes a release coating on at least a portion of the top surface 74 and is adhered to the pressure sensitive adhesive on the bottom surface of the face ply 64. The liner ply 73 is coextensive with the face ply 64.

The first and second portions 67, 68 of the face ply 64 are separated and may comprise different materials. The first portion 67 of the face ply 64 will be comprised of nylon taffeta coated white on two sides and the second portion 68 of the face ply 64 may comprise paper.

In the embodiment illustrated, the face ply 64 is adhered to the liner ply 73 by a pressure sensitive adhesive included on at least a portion of its bottom surface 66. In one embodiment, the pressure sensitive adhesive is included on the first portion 67 of the face ply 64 around the periphery of the wristband 63 and on the first and second ends 69, 70 of the wristband 63. The pressure sensitive adhesive is also included on the second portion 68 of the face ply 64 in the area containing the series of labels 62.

Figure 10:
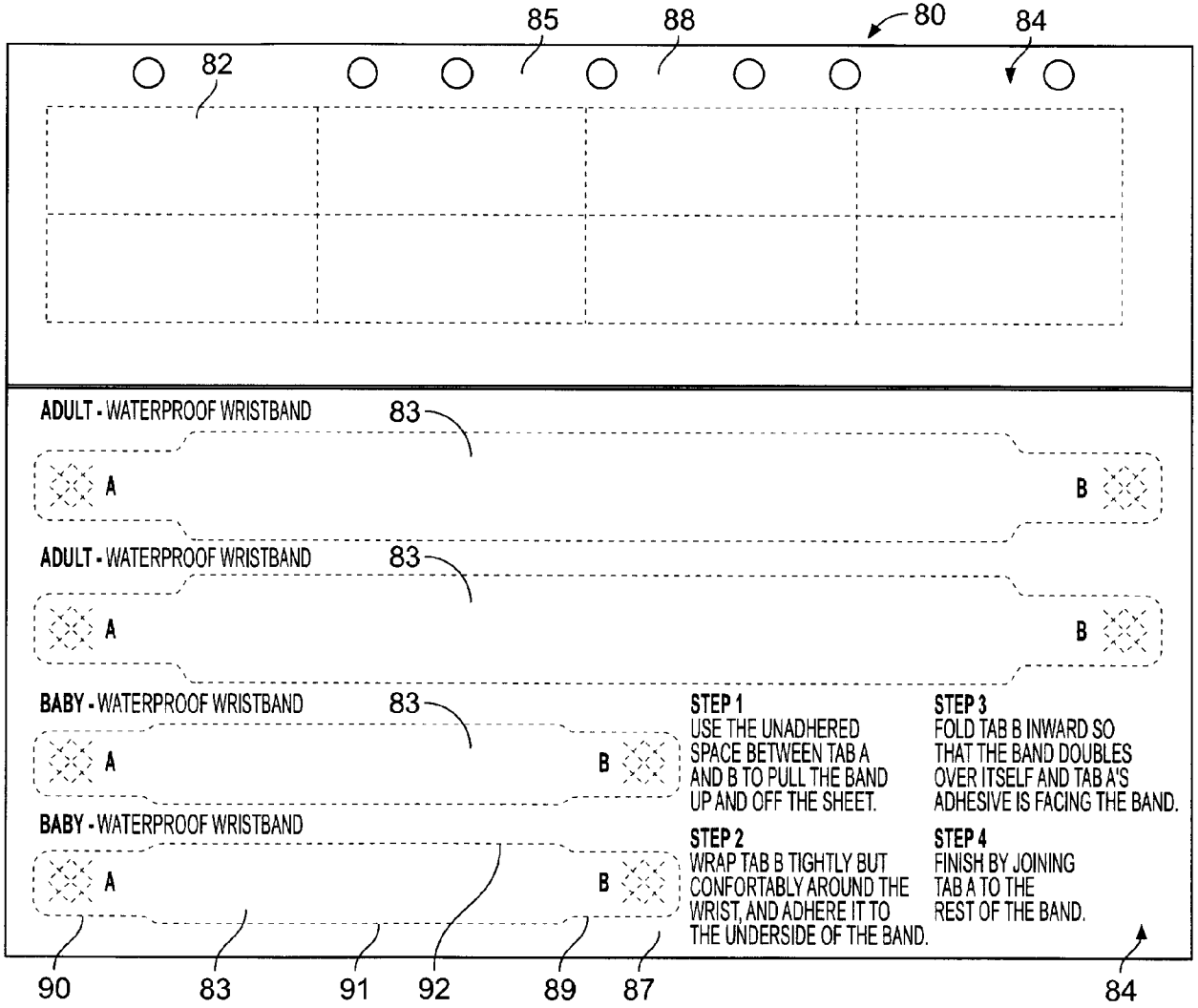
FIG. 10 is a top plan view of another embodiment of a form according to the present invention.
Figure 11:
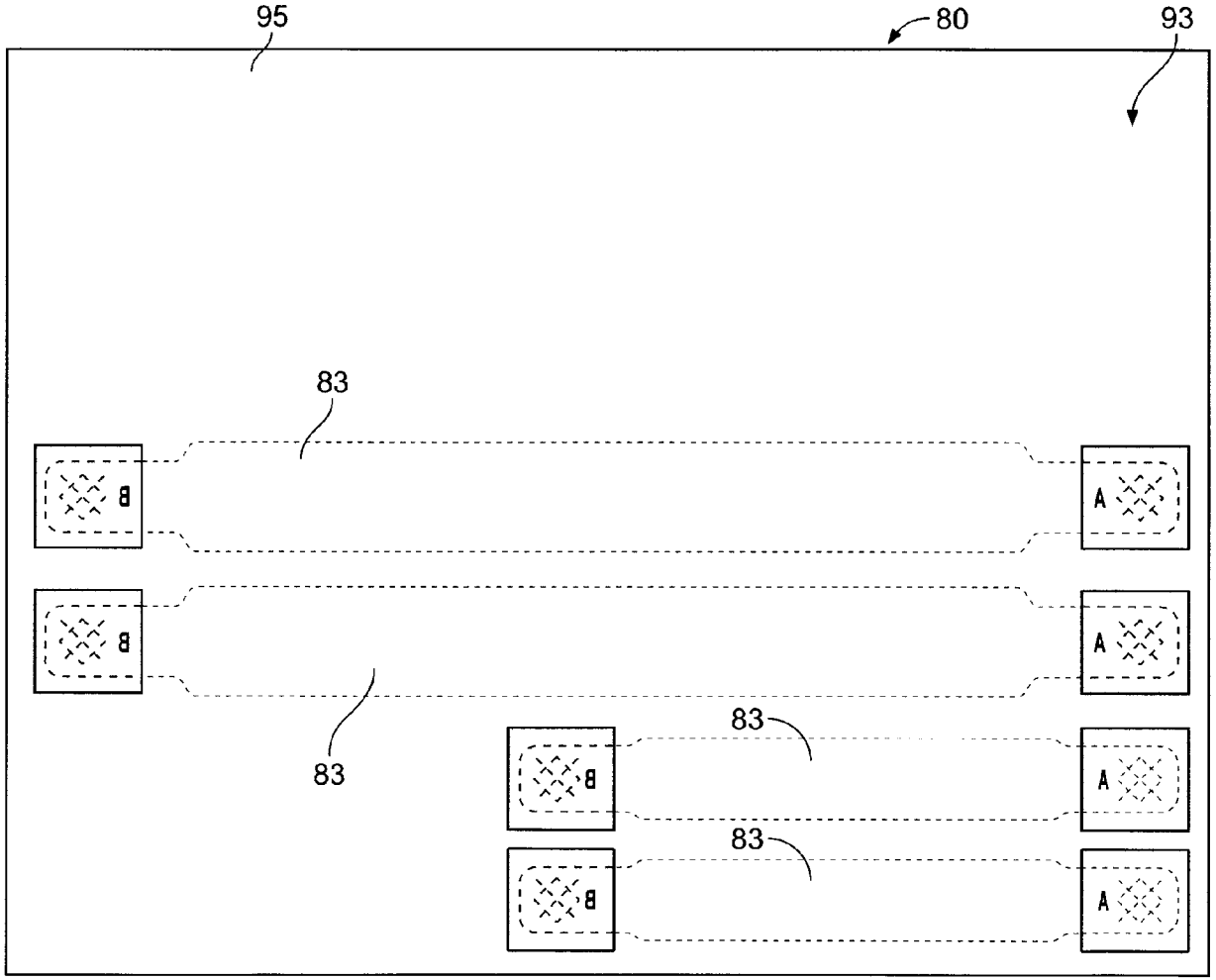
FIG. 11 is a back plan view of the form of FIG. 10.

FIGS. 10-11 show another embodiment of a form suitable for use in maternity or pediatric wards, generally indicated at 80, having detachable labels 82 and a series of wristbands 83 for the parents and a baby(s) or child. Form 80 comprises a printable face ply 84 having top 85 and bottom surfaces and having a pressure sensitive adhesive on at least a portion of the bottom surface thereof. The top surface 85 of the face ply 84 permits indicia to be printed thereon in a single pass through printer with both variable and non-variable information. The face ply 84 includes first 87 and second 88 adjacent portions, where the first portion 87 of the face ply 84 is die cut to form the series of detachable wristbands 83 of different sizes each having first and second 89, 90 ends and first and second sides 91, 92. The second portion 88 of the face ply 84 is die cut to form a series of detachable labels 82.

The form 80 also includes a liner ply 93 having top and bottom surfaces 94, 95. The liner ply 93 includes a release coating on at least a portion of the top surface 94 and is adhered to the pressure sensitive adhesive on the bottom surface of the face ply 84. The liner ply 9 is coextensive with the face ply 84.

The first and second portions 87, 88 of the face ply 84 are separated and may comprise different materials. The first portion 87 of the face ply 84 will be comprised of nylon taffeta coated white on two sides and the second portion 88 of the face ply 84 may comprise paper.

In the embodiment illustrated, the face ply 84 is adhered to the liner ply 93 by a pressure sensitive adhesive included on at least a portion of its bottom surface 86. In this embodiment, the pressure sensitive adhesive is included on the first portion 87 of the face ply 84 around the periphery of each of the wristbands 83 and on the first and second ends 89, 90 of the wristbands 83. Alternatively the snap enclosure shown in FIGS. 6-7 can be utilized. The pressure sensitive adhesive is also included on the second portion 88 of the face ply 24 in the area containing the series of labels 22.

Figure 12:
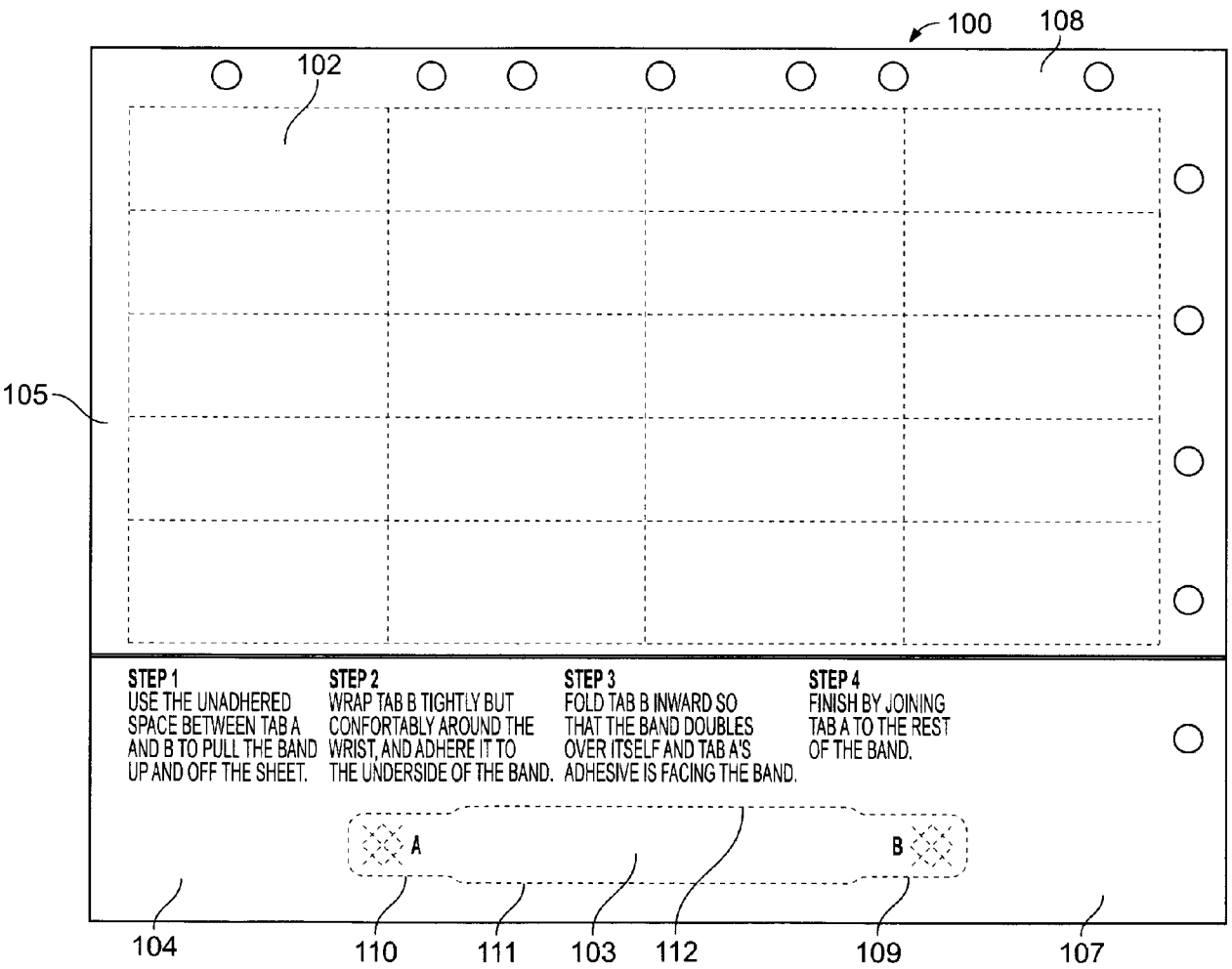
FIG. 12 is a top plan view of another embodiment of a form according to the present invention.
Figure 13:
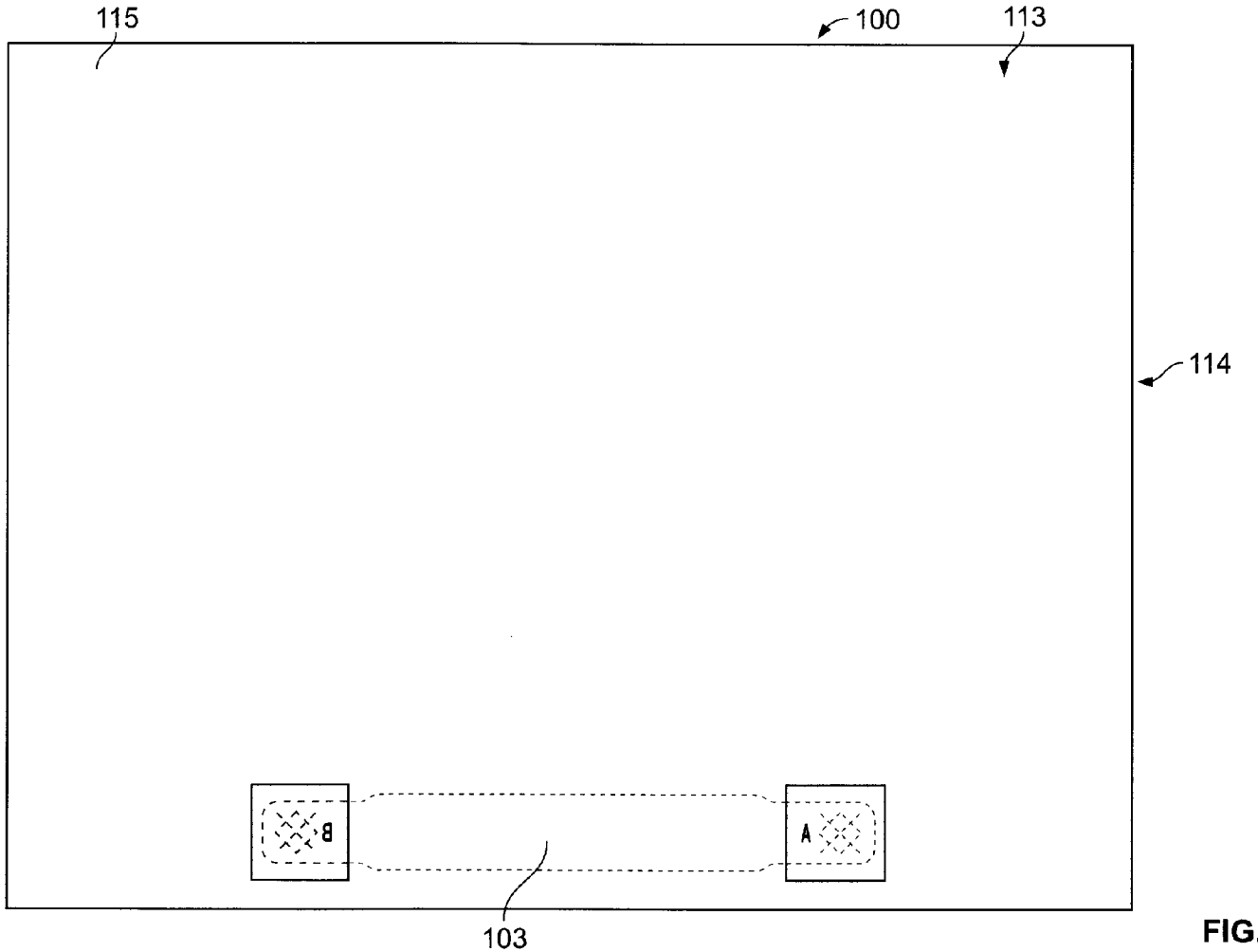
FIG. 13 is a back plan view of the form of FIG. 12.

FIGS. 12-13 show another embodiment of a form, generally indicated at 100, having detachable labels 102 and a wristband 103 sized for smaller patients from those for which the wristband for example in FIGS. 1-3 is appropriate. Form 100 comprises a printable face ply 104 having top 105 and bottom major surfaces and having a pressure sensitive adhesive on at least a portion of the bottom surface thereof. The top surface 105 of the face ply 104 permits indicia to be printed thereon in a single pass through printer with both variable and non-variable information. The face ply 104 includes first 107 and second 108 adjacent portions, where the first portion 107 of the face ply 104 is die cut to form a detachable wristband 103 having first and second 109, 110 ends and first and second sides 111, 112. The second portion 108 of the face ply 104 is die cut to form a series of detachable labels 102.

The form 100 also includes a liner ply 113 having top and bottom major surfaces 114, 115. The liner ply 113 includes a release coating on at least a portion of the top surface 114 and is adhered to the pressure sensitive adhesive on the bottom surface of the face ply 104. The liner ply 113 is coextensive with the face ply 104.

The first and second portions 107, 108 of the face ply 104 are separated and may comprise different materials. The first portion 107 of the face ply 104 will be comprised of nylon taffeta coated white on two sides and the second portion 108 of the face ply 104 may comprise paper.

In the embodiment illustrated, the face ply 104 is adhered to the liner ply 113 by a pressure sensitive adhesive included on at least a portion of its bottom surface. In one embodiment, the pressure sensitive adhesive is included on the first portion 107 of the face ply 104 around the periphery of the wristband 103 and on the first and second ends 109, 110 of the wristband 103. The pressure sensitive adhesive is also included on the second portion 108 of the face ply 104 in the area containing the series of labels 102.

The various examples and illustrations referred to in this disclosure are provided for the benefit of the reader, and are not intended to limit the implementation or practice of the invention except where explicitly referred to or otherwise required in the claims that follow. The size and shape of the form, number of labels, size and number of wristbands and the arrangement of the labels and wristband(s) can be varied. The devices and methods of this invention can be effectively refined or modified by routine optimization without departing from the spirit of the invention embodied in the claims.

The invention claimed is:

1. A form having one or more blank detachable wristbands, the form comprising:

a waterproof printable nylon taffeta face ply capable of accepting printed indicia and a liner ply, wherein the face ply is die cut to form one or more blank detachable wristbands having first and second ends, wherein the nylon taffeta is 4-6 mils thick and has a coating on at least a top surface configured to accept and retain printed indicia such that the wristbands are sufficiently waterproof and soft at hand to remain attached to a patient for several days without losing printed variable patient data, and wherein the face ply is adhered to the liner ply by a pressure sensitive adhesive included on at least a portion of its bottom surface and the pressure sensitive adhesive is included on the face ply around the periphery of the one or more wristbands; and means to secure the wristband to the wrist of a patient are located adjacent the first and second ends of the wristband and each of said first and second ends of each of the wristbands have tamper evident indicia.

2. The form according to claim 1, wherein the face ply is nylon taffeta coated white on two sides.

3. The form according to claim 2, wherein the means to secure the wristband to the wrist of a patient comprises pressure sensitive adhesive on a bottom surface of the first and second ends of each of the wristbands.

4. The form according to claim 3, wherein the wristband is configured to be applied a wrist of a patient such that the wristband wraps around the wrist whereby one of the ends of the wristband is folded back so its bottom surface is adhered to the bottom surface of the wristband wrapped over it and the other end of the wristband is adhered to the top surface of the wristband that it is wrapped over.

5. The form according to claim 4, wherein the end of the wristband that is configured to be folded back so its bottom surface is adhered to the bottom surface of the wristband wrapped over it when the wristband is applied to a wrist of a patient is marked on its top surface with identifying indicia, and wherein the other end of the wristband that is configured to be adhered to the top surface of the wristband that it is wrapped over when the wristband is applied to a wrist of a patient is marked on its top surface with different identifying indicia.

6. The form according to claim 1, wherein the means to secure the wristband to the wrist of a patient comprises a series of holes at the first and second ends of each wristband adapted to have a plastic snap enclosure inserted through a first hole on the first end and then after the wristband is wrapped around a patient's wrist, through a second hole on the second end of each wristband.

7. The form according to claim 1, wherein the tamper evident indicia comprises die cut x's on first and second ends of each of the wristbands with the bottom surface of each of the first and second ends of each of the wristbands printed a different colour from the rest of the wristband.

8. A form having a series of detachable labels and one or more blank detachable wristbands, the form comprising:

a printable face ply and a liner ply, the printable face ply having first and second adjacent portions, wherein the first portion of the face ply is a nylon taffeta material having a coating on at least its top surface configured to accept printed indicia, and wherein the first portion of the face ply is die cut to form one or more blank detachable wristbands having first and second ends, wherein the first portion of the face ply is sufficiently waterproof and soft at hand such that it may remain attached to a patient for several days without losing printed variable patient data, and wherein the second portion of the face ply is die cut to form the series of detachable labels;

the liner ply having a release coating on at least a portion of a top surface wherein the face ply is adhered to the liner ply by a pressure sensitive adhesive included on at least a portion of its bottom surface and the pressure sensitive adhesive is included on the face ply around the periphery of the one or more wristbands and on the first and second ends of each of the wristbands, each of said first and second ends of each of the wristbands provided with tamper evident indicia, and wherein the tamper evident indicia comprises die cut x's on first and second ends of each of the wristbands with the bottom surface of each of the first and second ends of each of the wristbands printed a different colour from the rest of the wristband.

9. The form according to claim 8, wherein the first and second portions of the face ply are separated and may comprise different materials.

10. The form according to claim 9, wherein the first portion of the face ply is nylon taffeta coated white on two sides and the second portion of the face ply is paper.

11. The form according claim 10, where the face ply is nylon taffeta sufficiently soft at hand and is 4-6 mils thick.

12. The form according to claim 8, wherein the pressure sensitive adhesive is also included on the entire second portion of the face ply.

13. A printable patient wristband made from nylon taffeta having a coating on at least its top surface in order to accept printed indicia such that it is sufficiently waterproof and soft at hand it may remain attached to a patient for several days without losing printed variable patient data and having first and second ends with a pressure sensitive adhesive included on a bottom surface of the first and second ends of each of the wristbands and each of said first and second ends of each of the wristbands provided with tamper evident indicia.

14. The printable wristband according to claim 13, wherein the tamper evident indicia comprises die cut x's on first and second ends of each of the wristbands with the bottom surface of each of the first and second ends of each of the wristbands printed a different colour from the rest of the wristband.

15. The printable wristband according to claim 13, wherein the wristband is configured to be applied a wrist of a patient such that the wristband wraps around the wrist whereby one of the ends of the wristband is folded back so its bottom surface is adhered to the bottom surface of the wristband wrapped over it and the other end of the wristband is adhered to the top surface of the wristband that it is wrapped over.

16. The printable wristband according to claim 15, wherein the end of the wristband that is configured to be folded back so its bottom surface is adhered to the bottom surface of the wristband wrapped over it when the wristband is applied to a wrist of a patient is marked on its top surface with identifying indicia, and wherein the other end of the wristband that is configured to be adhered to the top surface of the wristband that it is wrapped over when the wristband is applied to a wrist of a patient is marked on its top surface with different identifying indicia.

* * * * *